United States Patent [19]

Stiegelmann

[11] Patent Number: 5,028,141

[45] Date of Patent: Jul. 2, 1991

[54] MIXING MACHINE

[75] Inventor: Rene Stiegelmann, Staufen, Fed. Rep. of Germany

[73] Assignee: Ika-Maschinenbau Janke & Kunkel GmbH & Co. KG., Staufen, Fed. Rep. of Germany

[21] Appl. No.: 384,154

[22] Filed: Jul. 21, 1989

[30] Foreign Application Priority Data

Jul. 22, 1988 [DE] Fed. Rep. of Germany ..... 3824886

[51] Int. Cl.[5] ..... B01F 7/30

[52] U.S. Cl. ..... 366/245; 366/288; 366/298; 366/301; 366/331

[58] Field of Search ..... 366/347, 301, 287, 288, 366/300, 244, 245, 246, 247, 248, 297, 298, 331, 281, 282, 283, 284, 97, 100, 144, 149, 299, 250, 98, 64, 65, 66, 601, 279; 475/11; 277/55, 56, 57

[56] References Cited

U.S. PATENT DOCUMENTS

| | | | |
|---|---|---|---|
| 2,185,155 | 12/1939 | Meeker et al. | 366/288 X |
| 3,046,812 | 7/1962 | Beaman et al. | 366/287 X |
| 3,075,746 | 1/1963 | Yablonski et al. | 366/288 |
| 3,144,280 | 8/1964 | Sorenson | 277/57 X |
| 3,151,847 | 10/1964 | Brooomall . | |
| 3,482,823 | 12/1969 | Rechtin | 366/245 |
| 4,697,929 | 10/1987 | Muller | 366/97 |
| 4,715,723 | 12/1987 | Anderson et al. | 366/301 X |

FOREIGN PATENT DOCUMENTS

| | | |
|---|---|---|
| 918925 | 12/1954 | Fed. Rep. of Germany . |
| 3604505 | 8/1987 | Fed. Rep. of Germany . |
| 2164837 | 8/1973 | France . |
| 54-23003 | 2/1979 | Japan . |
| 412537 | 11/1966 | Switzerland . |
| 1039758 | 8/1966 | United Kingdom . |

*Primary Examiner*—Harvey C. Hornsby
*Assistant Examiner*—Scott J. Haugland
*Attorney, Agent, or Firm*—Peter K. Kontler

[57] ABSTRACT

An upright mixing machine has one or more rotary vertical mixing tools having blades beneath a gear case for transmissions which orbit and/or rotate the tools. The gear case has an upper section which is rotatably installed in a housing, and a lower section which can be separated from the upper section to be thereupon lowered by an elevator for the purpose of convenient inspection of bearings, seals, gears and/or other parts which necessitate frequent inspection, cleaning, other maintenance or replacement. The elevator also serves to raise and lower a vessel for batches of material or materials to be mixed by the mixing tool or tools. At least one section of the gear case has one or more observation windows which are accessible for observation and manipulation of parts within the respective section not later than upon detachment of the lower section from and its lowering beneath the upper section.

38 Claims, 2 Drawing Sheets

22
20
23a
26
9
23
27
24
2
11
1
17
2
15
19
15
2
42
42
2
130
130
32
32
48
116
16
36
37
35
34
33
29
39
5b
5b
31
39
38
8
38
30
30
8
8
5a
47
47
132

MIXING MACHINE

CROSS-REFERENCE TO RELATED CASES

The machine of the present invention constitutes an improvement over and a further development of mixing machines which are disclosed in commonly owned copending patent application Ser. No. 377,928 filed July 10, 1989 by Uwe Grimm for "Mixing apparatus" and in commonly owned copending patent application Ser. No. 384,155 filed July 21, 1989 by Uwe Grimm for "Mixing apparatus with composite mixing tools".

BACKGROUND OF THE INVENTION

The invention relates to improvements in machines for kneading, stirring and/or otherwise mixing and agitating liquid, flowable solid and/or viscous materials. More particularly, the invention relates to improvements in upright mixing machines of the type wherein one or more vertical or substantially vertical mixing tools extend downwardly beyond a housing and into a vessel which contains a batch of miscible material or materials.

It is already known to provide an upright mixing machine with a gear case which is rotatably mounted in the housing at a level above the vessel and supports one or more tools (e.g., one or more tools which have mixing elements in the form of blades) in addition to containing bearings, gears, seals and other parts which are used to rotate the tool or tools, to properly mount the tool or tools in the gear case, as well as to prevent penetration of mixcible material or materials from the vessel into the gear case and/or into the housing. It is also known to install the gear case in such a way that it can be removed from the housing of the upright mixing machine. If the gear case supports two or more tools, the tools normally include a centrally located tool which can be rotated about its own axis and one or more lateral or outer tools which are rotatable about their own axes and can also orbit about the centrally located tool. The gear case then constitutes the carrier of a planetary transmission which is installed in the housing to rotate the tools about their own axes as well as to orbit the outer tool or tools about the centrally located tool. The sun wheel or wheels and the planet wheel or wheels of the transmission are or can be mounted in the interior of the hollow gear case. The means for rotating the gear case (planet carrier) about its own axis (which normally coincides with the axis of the centrally located mixing tool) includes a motor and a gear train between the output element of the motor and the gear case. Rotation of the gear case entails rotation of each mixing tool about its own axis and orbital movement of the outer tool or tools (if any) about the centrally located tool. The planetary transmission can include two units one of which serves to orbit the outer tool or tools about the centrally located tool and the other of which serves to rotate the centrally located tool in response to composite orbital and rotary movement of the outer tool or tools. The arrangement is such that, if the lower end portions of the mixing tools carry blades or analogous mixing elements, the paths of circular movement of radially outermost portions of the blades cross each other when the centrally located tool rotates about its own axis while the outer tool or tools rotate about their respective axes and simultaneously orbit about the centrally located tool, but such movements of the tools do not entail any clashing of the blades.

As a rule, the housing and the vessel of a standard upright mixing machine of the above outlined character are installed at a level well above the floor level or above the level of the base of the machine frame. This renders it possible to raise a vessel, which contains a fresh batch of material to be mixed, toward the underside of the housing so that the mixing element or elements of the mixing tool or tools enter the vessel from above as the vessel is caused to move upwardly. When the mixing of a batch is completed, the vessel is lowered and is ready to be relieved of its contents or to be replaced with a vessel containing a fresh batch. Such mixing machines are used extensively for the making of tough plastic masses of doughy consistency from liquid, flowable solid and/or viscous materials. For example, the ultimate product can constitute a propellant or an explosive.

A drawback of presently known upright mixing machines which are used for the making of explosives, propellants and/or other dangerous or potentially dangerous products is that cleaning, inspection, maintenance and/or replacement of tools and/or other parts takes up inordinately long periods of time. On the other hand, such work must be performed at frequent intervals because penetration of a propellant or explosive into and accidental combustion in the gear case and/or housing can result in extensive damage to or in total destruction of the machine or of a portion of or the entire plant, and in injuries to attendants or fatal accidents. As a rule, a mixing machine which is used for the making of explosives or propellants must be inspected and thoroughly cleaned at regular intervals. For example, the persons in charge must ensure that no explosive has penetrated between the teeth of mating gears, into the bearings for the mixing tool or tools, or between other parts (such as the gear case and the housing) which move or are likely to move relative to each other when the machine is in use. Such mixing machines normally comprise various static and dynamic seals which must be inspected at frequent intervals in order to ensure timely detection of leakages. The same applies for the backlash or flank clearance between the teeth of mating spur gears, bevel gears, worms and worm wheels and other torque transmitting components. The absence of excessive flank clearance is particularly important when the mixing machine comprises several mixing tools and the blades or otherwise configurated mixing elements of the tools must rotate and/or orbit without clashing and without coming in contact with the vessel.

The reason that the inspection of a conventional mixing machine is a time-consuming operation, which necessitates long periods of idleness of the machine, is that the gear case and the parts which are carried by the gear case must be lifted above the housing in order to afford access to those parts which must be cleaned, inspected, serviced and/or replaced. Moreover, the inspection can be carried out only if there is ample space above the housing of the mixing machine, not only for the lifted gear case but particularly for the lifting equipment (e.g., a crane) which is used to raise the gear case above and out of its housing. While the mounting of the gear case from above, or the removal of gear case from the housing by moving the gear case upwardly, does not necessarily create problems in the plant in which the mixing machine is assembled, a plant in which the mixing machine is put to use is much less likely to provide adequate space at a level above the housing and/or to have adequate equipment which can be used to carry out such operation. The situation is aggravated due to the fact that the height of an assembled upright mixing machine is considerable because, and as mentioned above, the machine must be designed to provide room for moving the vessel up and down in the space beneath the housing for the gear case. As a rule, the gear case can be lifted above and out of the housing only if the available space above the housing is several meters high. This provides room for an overhead crane or another suitable lifting machine and for the gear case and the mixing tool or tools in raised position of the gear case. Such substantial amount of space above the mixing machine is not always available (in fact, it is hardly ever available) in a plant wherein the machine is or is to be put to use.

Another drawback of presently known upright mixing machines is that the gear case and its tool or tools can be withdrawn from and reinserted into the housing only by highly skilled operators. One of the main reasons that highly skilled operators must be called to perform such work is that an unskilled person, or a person not fully familiar with the mixing machine, is likely to damage delicate seals which are interposed between the working chamber (for the rotary and other parts of the means for rotating, orbiting and journalling the mixing tool or tools) and the (mixing) station for the exposed part or parts of the mixing tool or tools and for the vessel which contains the batch of material or materials to be mixed.

Applicant is aware of disclosures in German Pat. No. 918,925 and U.S. Pat. No. 3,151,847 which disclose mixing machines with rotary gear cases. The gear cases of the patented mixing machines do not permit convenient observation of the parts in the gear case.

OBJECTS OF THE INVENTION

An object of the invention is to provide a mixing machine which can be inspected, taken apart and reassembled within shorter intervals of time than heretofore known mixing machines.

Another object of the invention is to provide an upright mixing machine wherein the parts to be inspected can be removed from the housing without the need for any, or for a substantial amount of, space above the housing.

A further object of the invention is to provide an upright mixing machine with a built-in system for facilitating partial dismantling preparatory to inspection, cleaning and/or repair.

An additional object of the invention is to provide a mixing machine which is constructed and assembled in such a way that the mechanism which is used to manipulate the mixing vessel can also perform other useful functions.

Still another object of the invention is to provide a novel and improved gear case and a novel and improved transmission for use in the above outlined mixing machine.

A further object of the invention is to provide the mixing machine with novel and improved means for affording convenient access to parts which require frequent inspection.

Another object of the invention is to provide the machine with novel and improved means for confining the gear case for the mixing tool or tools.

A further object of the invention is to provide a novel and improved method of assembling and dismantling an upright mixing machine.

An additional object of the invention is to provide a mixing machine whose space requirements are a fraction of those of heretofore known machines.

Another object of the invention is to provide a mixing machine which can be readily assembled or taken apart at the locale of use and is constructed and assembled in such a way that the assembling and dismantling work can be carried out by persons having average skill in the relevant art.

An additional object of the invention is to provide a mixing machine the output of which is higher than that of heretofore known mixing machines.

SUMMARY OF THE INVENTION

The invention is embodied in a mixing machine which comprises a housing, a gear case which is provided in and is rotatable relative to the housing about a substantially vertical axis and includes a first section journalled in the housing and a second section, fastener means engageable to separably and non-rotatably secure the second section to the first section, at least one upright mixing tool which is rotatably mounted in the second section, and means for rotating the at least one tool. The rotating means is installed in the second section of the gear case, and the second section is movable downwardly (with the at least one tool and with a portion at least of the rotating means) relative to the housing and relative to the first section upon disengagement of the fastener means. Furthermore, at least one section of the gear case has at least one observation window. The arrangement is preferably such that the observation window is available or accessible for observation of and/or access to the part of parts behind it upon downward movement of the second section.

One of the sections is or can be at least partially confined in the other section when the second section is secured to the first section. It is presently preferred to design the gear case in such a way that the second section is at least partially receivable in the first section. Furthermore, the design of the gear case is or can be such that the upper side of the second section abuts the underside of the first section when the second section is properly secured to the first section.

The fastener means is preferably engageable to non-rotatably and separably connect the upper portion of the second section to the first section. The shaft of the at least one tool is rotatably mounted in at least one (upper and/or lower) portion of the second section.

The gear case preferably includes a twin-walled portion with an outer wall which forms part of the first section and an inner wall which forms part of the second section. The at least one observation window is or can be provided in the inner wall and is or can be exposed upon downward movement of the second section.

The mixing machine further comprises a prime mover and means for transmitting torque from the prime mover to the gear case, preferably to the first section. The means for rotating the at least one mixing tool can comprise a planetary transmission and the gear case can constitute the planet carrier of such transmission. The torque transmitting means can comprise a first gear which is driven by the prime mover (such first gear can be mounted directly on the output element of the prime mover) and a second gear which is rigid with the gear case and mates with the first gear. The second gear can constitute a ring gear which is coaxial with and is connected to the first section of the gear case. Such second gear is or can be rotatably mounted in the housing, and the torque transmitting means can further comprise a flange which is rigid with the first section and means (e.g., bolts or screws) for separably connecting the flange to the second gear.

At least one seal (preferably a labyrinth seal) is provided between the housing and at least one of the two sections of the gear case. Such seal can comprise an annular groove in the first section of the gear case and an annular projection which is provided on the housing and extends with clearance into the annular groove.

In accordance with a presently preferred embodiment, the first section of the gear case constitutes or resembles an inverted cup and the second section includes a tube which is at least partially received in the cup when the second section is secured to the first section. The first section comprises a top wall, and the fastener means can include at least one threaded fastener which separably secures the top wall of the first section to the second section. Such fastener has a head which is accessible from above the top wall of the first section. The housing of the mixing machine preferably includes a main portion which at least partially surrounds and confines the gear case, and a cover which is located above the gear case and is removably secured to the main portion by suitable connecting means so that, when the cover is lifted off or is otherwise moved relative to the main portion of the housing, the head of the threaded fastener becomes accessible to permit separation of the second section from the first section of the gear case.

The sun wheel of the aforementioned planetary transmission is or can be carried by the cover of the housing. Means can be provided for lifting the cover and the sun wheel off the main portion of the housing upon removal of the connecting means.

The second section of the gear case has or can have an open top (such open top can be said to constitute an observation window) and a tubular portion adjacent the open top. The at least one observation window can be constituted by the open top and/or can be provided in the tubular portion of the second section so that it is accessible upon downward movement of the second section.

Annular portions of the two sections sealingly engage each other when the second section is secured to the first section. Such sections then define a driving chamber for the rotating means, bearings, at least some seals and/or other parts in the gear case, and the annular portions of the two sections seal such driving chamber from a mixing or product chamber which is located beneath the gear case and receives a vessel when the machine is in use.

The second section of the gear case can include an external annular flange, and the first section can include an annular portion above and adjacent the external flange. The aforementioned labyrinth seal can be provided between such annular portion of the first section and the external flange of the second section. In addition to or in lieu of the labyrinth seal, the mixing machine can comprise a sealing ring between the annular portion of the first section and the external flange of the second section.

The mixing machine further comprises a frame. The housing is preferably mounted in the frame at a first level and the aforementioned vessel is removably mounted in the frame (and can be affixed to the housing) at a second level below the first level, namely beneath the gear case so that the exposed lower portion of each mixing tool extends into the vessel. Elevator means can be provided in the frame to lower the second section of the gear case away from and to lift the second section toward the housing. The frame includes a base and the housing is preferably located in the frame above and is spaced apart from the base.

The elevator means can comprise a plurality of carriages beneath the housing, means (preferably one or more fluid-operated motors) for moving the carriages up and down, and a second frame (hereinafter called superstructure) which is disposed above the carriages and is movable with the carriages upwardly toward and downwardly away from the housing. The frame can include two pairs of upright columns, and the elevator means can comprise two carriages each of which is mounted for up-and-down movement along one pair of columns. The moving means preferably includes means for moving the carriages in synchronism upwardly toward and downwardly away from the housing so that the second section of the gear case can come to rest upon the superstructure in raised positions of the carriages and upon disengagement of the fastener means (i.e., upon detachment of the second section from the first section).

The superstructure can include a floor-contacting portion which comes to rest on the floor at least in response to lowering of the carriages. The carriages are movable to lower end positions in which the superstructure is preferably disengaged from and is movable along the floor relative to the carriages. The floor-contacting portion of the superstructure can include a vehicle (e.g.-,.a dolly or a motor-driven conveyance which can be used to move the superstructure and the second section of the gear case away from the mixing station and/or to move the vessel toward or away from a position of registry with the housing).

The superstructure can include or carry a support and the second section of the gear case can include an external flange which comes to rest on the support of the superstructure in raised positions of the carriages and superstructure upon disengagement of the second section from the first section. The support can include a plurality of discrete reinforced portions on the superstructure.

The support can be provided with a plurality of upwardly extending centering elements for the external flange of the second section of the gear case. Such centering elements can form an annulus which surrounds the flange in raised position of the superstructure.

As mentioned above, the carriages can be moved (lowered) relative to the superstructure (when the aforementioned conveyance rests on the floor or when the superstructure is lowered onto the conveyance if the latter is not movable up and down with the superstructure) and, therefore, the mixing machine preferably further comprises means for centering the superstructure on the carriages. Such centering means can comprise one or more upwardly extending studs on each carriage and complementary sockets provided in the superstructure to receive the studs when the carriages are lifted toward the superstructure.

When a vessel rests on the superstructure in raised positions of the carriages, the lower portion of each mixing tool extends into the vessel and can mix the batch of miscible material in the vessel. At such time, the superstructure serves as a support for the vessel. Alternatively, the superstructure can be removed from the mixing station by the aforementioned conveyance, and the vessel then rests directly on the carriages. To this end, the vessel can be provided with sockets which receive the aforementioned centering studs of the carriages. Accurate positioning of the vessel with reference to the assembled gear case is important when the gear case supports several mixing tools at least one of which orbits about a centrally located mixing tool and such orbital movement takes place in close or immediate proximity to the internal surface of a lifted vessel.

The aforementioned lifting means for the cover of the housing can include a first upright shaft on the main portion of the housing, and a second upright shaft which is coaxial with the first shaft and is connected to the cover, preferably by way of a substantially horizontal arm. One of the shafts is telescoped into the other shaft and the second shaft is rotatable and movable axially relative to the first shaft. The lifting means can further comprise a hydraulic motor or other suitable means for moving the second shaft axially with reference to the first shaft. The moving means can comprise a fluid-operated cylinder and piston unit which is coaxial with the shafts.

The novel features which are considered as characteristic of the invention are set forth in particular in the appended claims. The improved mixing machine itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
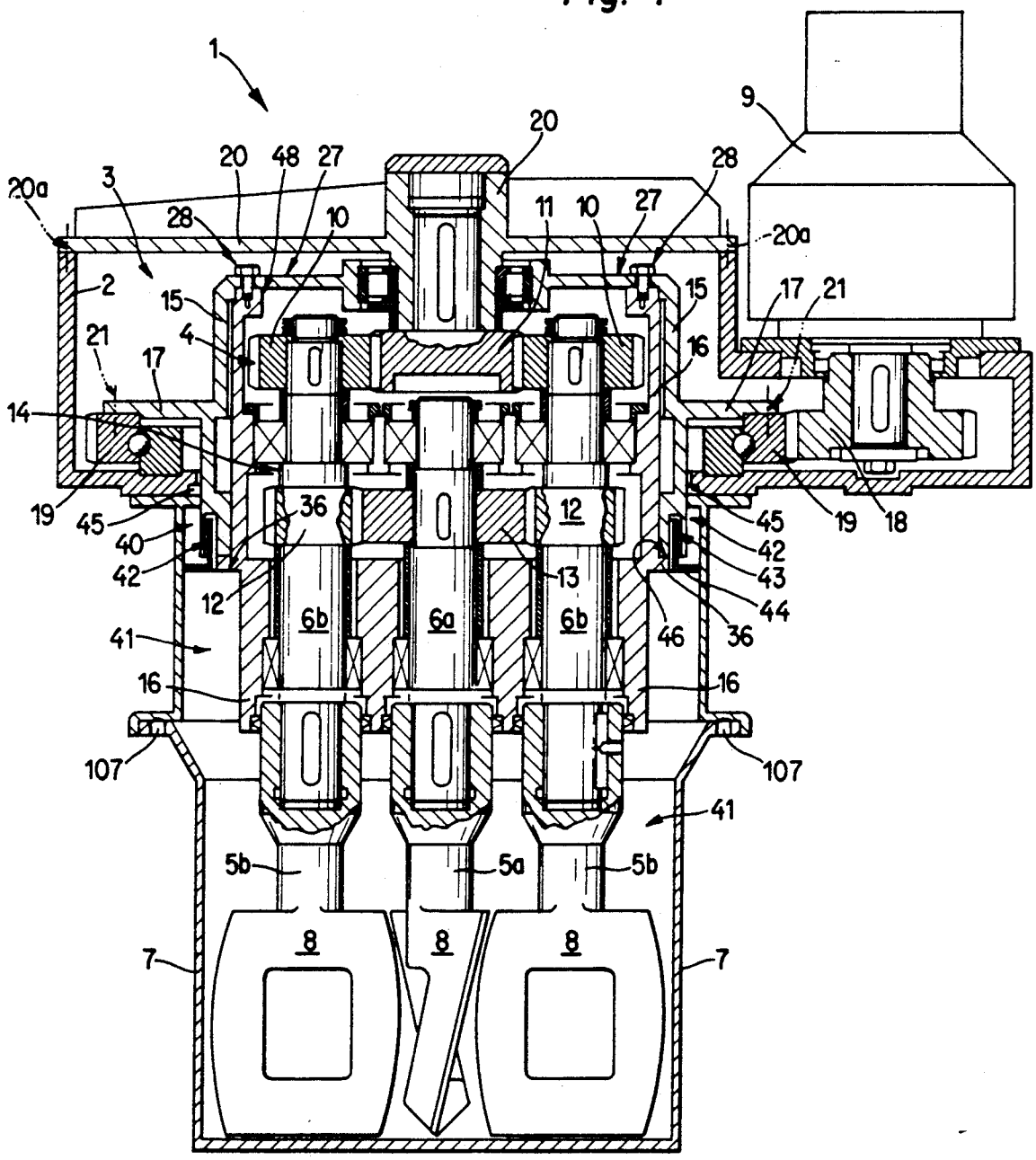
FIG. 1 is a fragmentary partly front elevational and partly vertical sectional view of the upper part of an upright mixing machine which embodies one form of the invention, the vessel being maintained in the operative position and the second section of the gear case being separably secured to the first section.

FIG. 1 shows a portion of an upright mixing machine 1 which comprises a housing 2 for a rotary gear case 3 which constitutes the planet carrier of a planetary transmission 4. The gear case 3 supports three upright rotary mixing tools including a centrally located mixing tool 5*a* which is coaxial with the gear case and two outer or lateral mixing tools 5*b* which are parallel to the mixing tool 5*a* and are mounted diametrically opposite each other with reference to the common axis of the gear case 3 and tool 5*a*. Each of the three mixing tools rotates about its own axis, and the mixing tools 5*b* orbit about the mixing tool 5*a* when the mixing machine 1 is in use. The shaft 6*a* of the centrally located mixing tool 5*a* is rotatably journalled in suitable antifriction bearings in the gear case 3, and its lower end portion carries a mixing element 8 (here shown as a blade) which extends into a batch of miscible material in the interior of a vessel 7 at a mixing or product station 41 beneath the gear case 3 and housing 2. The shafts 6*b* of the outer mixing tools 5*b* are parallel to the shaft 6*a* and are mounted in bearings which are also confined in the gear case 3. The lower end portions of the shafts 6*b* carry mixing elements in the form of blades 8 which are received in the properly mounted vessel 7 and rotate with reference to the blade 8 of the shaft 6*a*. The arrangement is such that the circular paths of radially outermost portions of blades 8 on the shafts 6*b* cross the circular paths of radially outermost portions of the blade 8 on the shaft 6*a* but these blades do not contact each other at any stage of rotation of the shafts 6*a*, 6*b* about their own axes and/or orbital movement of blades 8 on the shafts 6*b* about the centrally located tool 5*a*. It will be noted that the blades 8 of the outer shafts 6*b* are closely or immediately adjacent the internal surface of the vessel 7.

The blades 8 of the outer shafts 6*b* produce a pronounced shearing effect which results in thorough mixing of material adjacent the internal surface of the vessel 7. The same applies for the mixing effect upon the material in the clearances between the blades 8 of the outer shafts 6*b* and the blade 8 of the centrally located shaft 6*a*. Orbital movements of the blades 8 on the outer shafts 6*b* enhance the mixing action which is produced as a result of rotation of each blade 8 about the axis of the respective mixing tool. The just described distribution of mixing elements 8 and the just described mode of rotating and orbiting the mixing elements ensure rapid, thorough and predictable mixing of liquid, flowable solid and/or viscous materials in the vessel 7. Thorough mixing of the batch consisting of one or more materials in the vessel 7 is particularly important if the wall of the vessel is heated or cooled and the batch is to exchange heat with such wall while the mixing machine 1 is in actual use.

The means for rotating the gear case 3 relative to the housing 2 comprises a prime mover 9 (e.g., a reversible variable-speed electric motor) which is mounted on the housing 2 or on the main frame of the mixing machine and transmits torque to the gear case by way of two gears 18, 19. The gear 18 is mounted directly on the vertical output element of the prime mover 9 and meshes with the gear 19 which is a ring gear coaxial with the gear case 3 and separably connected to a first (upper or outer) section 15 of the gear case. The latter further comprises a second (lower or inner) section 16 which, in accordance with a feature of the invention, is separably secured to the first section 15 by several threaded fasteners 28. The planetary transmission 4 is confined in the gear case 3 and includes a planet wheel 10 (preferably a gear) on each outer shaft 6*b*, and a stationary sun wheel 11 (preferably a gear) which is supported by a cover 20 of the housing 2. The planet wheels 10 engage and roll around the stationary sun wheel 11 when the gear case 3 is rotated by the prime mover 9. This not only causes the shafts 6*b* to rotate about their respective axes but also causes the outer tools 5*b* to orbit about the centrally located tool 5*a*.

The means for rotating the shaft 6*a* of the centrally located mixing tool 5*a* comprises a second planetary transmission 14 which is also installed in the gear case 3 and includes a sun wheel 13 (preferably a gear) on the shaft 6*a* and a planet wheel 12 (preferably a gear) on each of the shafts 6*b*. The planet wheels 12 engage the sun wheel 13 and compel the latter to rotate about its own axis (i.e., to rotate the tool 5*a*) when the gear case 3 rotates to thus cause the shafts 6*b* to rotate about their own axes as well as to orbit about the shaft 6a. The ratios of planetary transmissions 4 and 14 are selected in the aforedescribed manner, namely that the rotating blade 8 on the lower portion of the shaft 6a cannot strike against the rotating and orbiting blades 8 on the lower end portions of the shafts 6b.

Proper selection of ratios of the transmissions 4, 14 and proper mounting of the vessel 7 relative to the blades 8 on the outer shafts 6b is particularly important when the batch of miscible material in the vessel is to be converted into an explosive or into a propellant. When the mixing machine 1 is used for the making of such products, its parts must be inspected, cleaned and/or otherwise maintained at rather frequent intervals. For example, it is important to prevent penetration of an explosive substance into the bearings for the shafts 6a, 6b, between the mating teeth of planet wheels 10 and sun wheel 11, between the mating teeth of the planet wheel 12 and sun wheel 13, and/or between the mating teeth of the gears 18, 19. Even minute quantities of explosive between the teeth of mating gears or wheels can cause explosions with extensive damage to or total destruction of parts of or the entire mixing machine and the surrounding area. The inspection involves a determination whether or not certain parts must be cleaned as well as a determination of the extent of backlash (flank clearance) between the mating gear teeth. Moreover, an inspection will normally involve an examination of all dynamic and static bearings which are used in or on the mixing machine and should be capable of preventing penetration of the substance or substances to be mixed and/or of the ultimate product into certain particularly sensitive zones in the housing 2 and gear case 3. Still further, the inspection will involve an examination of all bearings for the shafts 6a, 6b, for the gear 19 and for the rotary gear case 3. For example, the flank clearance or backlash between the teeth of planet wheels 12 on the one hand and sun wheel 13 on the other hand must be maintained within very close tolerances in order to reliably prevent clashing of the blade 8 on the shaft 6a with the blades 8 on the shafts 6b when the mixing machine is in use and the aforediscussed circular paths of radially outermost portions of the blades 8 cross each other as a result of rotation of shafts 6a, 6b about their own axes and simultaneous orbital movement of blades 8 on the shafts 6b about the blade 8 on the shaft 6a. Such close tolerances must be maintained on the additional ground that any, even slight, wobbling of the outer shafts 6b could result in actual contact between the blades 8 on these shafts and the internal surface of the vessel 7.

Each inspection involves an interruption of production and, therefore, it is important to design the mixing machine 1 with a view to ensure that an inspection can be completed within a very short interval of time. This is accomplished, to a considerable extent, in that the gear case 3 is assembled of two horizontally separable sections 15 and 16 and in that the section 16 can be lowered beneath and lifted toward the housing 2 and section 15. Such design of the gear case 3 and such movability of the section 16 not only entail considerable savings in time for the assembling and dismantling of the mixture machine but also ensure that such operations can be carried out in a space-saving manner and by resorting to relatively simple and compact equipment. Moreover, the assembling and dismantling operations are relatively simple and, therefore, they can be carried out by employees at the plant where the mixing machine is put to use, i.e., it is not necessary to invariably invite a specialist from the plant where the mixing machine was produced.

As can be seen in FIG. 1, the upper portion of the generally tubular section 16 is received in the inverted cup-shaped section 15 in assembled condition of the gear case 3. In other words, the assembled gear case 3 comprises a twin-walled portion with an outer wall forming part of the section 15 and an inner wall forming part of the section 16. FIG. 1 further shows that the upper side of the upper portion of second section 16 abuts or is immediately adjacent the underside of a top wall 27 of the section 15 when the gear case 3 is properly assembled, namely when the heads of threaded fasteners 28 abut the upper side of the top wall 27 and their externally threaded shanks extend through untapped holes in the top wall 27 and into complementary tapped bores in the upper portion of the section 16.

Figure 2:
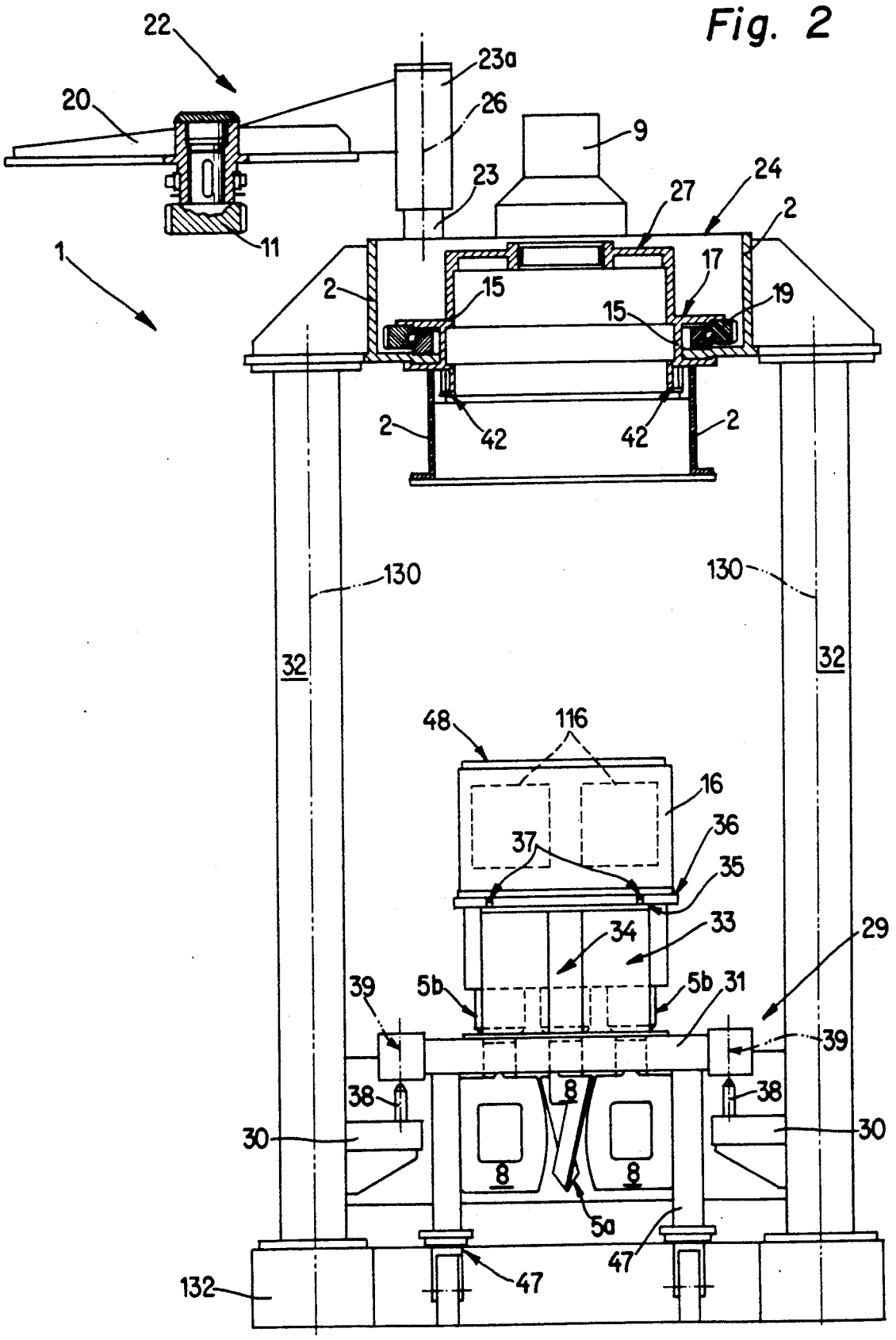
FIG. 2 is a smaller-scale side elevational view of the mixing machine, with the vessel removed and the second section detached from and lowered below the first section.

The two pairs of planet wheels 10, 12 and the sun wheels 11, 13 are confined only in the section 16 of the gear case 3 when the latter is fully assembled. Moreover, with the sole exception of the upper sun wheel 11, all parts of the means for rotating and orbiting the mixing tools 6a, 6b are lowered with the second section 16 when the fasteners 28 are disengaged from the upper portion of the section 16 so that the latter can descend to a level below the housing 2 (see FIG. 2). Such lowering of the section 16 results in exposure of one or more observation windows in the section 15 and/or 16. FIG. 2 shows, by broken lines, two observation windows 116 (e.g., in the form of cutouts) which are provided in the tubular portion of the second section 16 and enable the operators to inspect and reach the planet wheels 10 and 12, the sun wheel 13, the bearings for the shafts 6a, 6b, the seals and/or other parts which cannot be seen and/or reached through the windows 116 in assembled condition of the gear case 3. For example, the windows 116 will be dimensioned and their positions in the tubular portion of the section 16 will be selected in such a way that the operators can readily ascertain the flank clearance between the teeth of planet wheels 12 on the one hand and the teeth of sun wheel 13 on the other hand. These same windows 116 can also serve to permit observation of flank clearance between the sun wheel 11 and the planet wheels 10 if the sun wheel 11 is carried by the section 16 (rather than by the cover 20 of the housing 2 as actually shown in the drawing). In other words, the observation windows render it possible to complete an inspection of and to reach several parts in the section 16 without it being necessary to remove the parts from such section.

FIG. 2 shows that the mixing apparatus 1 further comprises a main frame having a base 132 and preferably four upright columns 32 which support the housing 2 at a level well above the base 132. This is desirable and advantageous because the space beneath the housing 2 is available for lowering of the section 16 to the illustrated position as well as for lowering of a vessel 7 and for return movement of the same vessel or a second vessel (containing a fresh batch of material to be mixed) to its operative position at the mixing station (chamber 41 of FIG. 1). The lowered section 16 is available for convenient inspection of the parts therein (through the observation window constituted by the open top 48 and/or through the windows 116) and such parts can be readily removed, inspected and replaced, if necessary, within short intervals of time.

Since the second section 16 of the gear case 3 can be reached by moving it downwardly and away from the housing 2 and section 15, the plant wherein the mixing machine 1 is put to use need not be equipped with a crane for the lifting of the entire gear case 3 above the housing 2 (as is customary in conventional upright mixing machines) and the housing 2 can be located close to the roof of the establishment in which the mixing machine is used. All that is necessary is to provide above the housing 2 adequate space for lifting (if and when necessary) of the relatively flat (short) upper section 15. Such section is not heavy (especially when its weight is compared with the weight of the section 16 and of the parts, including the mixing tools, which are carried by the section 16) so that a relatively small crane or another lifting device suffices to raise the section 15 to a level which is necessary for convenient inspection and/or complete removal from the mixing machine. In order to further reduce the weight of the part (section 15) which must be lifted above the housing 2 (actually above the main portion of the housing 2 upon detachment of the cover 20), the aforementioned motion transmitting means between the first section 15 and the prime mover 9 comprises means 21 for separably connecting the rather large ring gear 19 to a flange 17 of the section 15. The connecting means 21 comprises bolts, screws or other suitable fasteners or connectors (two indicated in FIG. 1 by phantom lines). The ring gear 19 is rotatably mounted in the housing 2 and, when properly connected to the flange 17, rotates the entire gear case 2 as long as the prime mover 9 is on. The connectors 21 are accessible when the cover 20 is lifted off the main portion of the housing 2 by a lifting mechanism 22 which is shown in the upper left-hand portion of FIG. 2. Once the connectors 21 are removed or loosened, a small crane suffices to lift the section 15 to a required level for inspection and/or for movement laterally of and away from the main portion of the housing 2.

The lifting mechanism 22 for the cover 20 of the housing 2 and for the sun wheel 11 of the transmission 4 comprises a first upright shaft 23 which is secured to the main frame or to the main portion of the housing 2 and is telescoped into a hollow second shaft **23*a*. The latter is provided with a radially extending arm 25 which is separably connected to or is made integral with the cover 20. A fluid-operated motor (e.g., a hydraulic cylinder and piston unit 26 which is indicated in FIG. 2 by a vertical phantom line and is coaxial with the shafts 23, 23*a*) is provided to move the shaft 23*a* up and down relative to the shaft 23. The shaft 23*a* can be rotated by hand or by a motor to move the cover 20 between the position which is shown in FIG. 2 and a position of register with the open top 24 of the main portion of the housing 2. The motor 26 then causes the shaft 23*a* to descend and to deposit the cover 20 on the main portion of the housing 2**.

FIG. 2 further shows an elevator 29 which is used to raise and lower the section 16 of the gear case 3 as well as the vessel 7 (not shown in FIG. 2). As explained above, the section 16 can be lowered as soon as the fasteners 28 are loosened or removed so that the section 16 is free to move with reference to the housing 2 and section 15. The heads of the fasteners 28 are accessible as soon as the cover 20 is lifted off the main portion of the housing 2. In fact, the cover 20 can be provided with preferably sealable openings (not specifically shown) which afford access to the fasteners 28 even while the cover 20 remains in the operative position of FIG. 1.

The elevator 29 comprises two carriages 30 each of which is guided by a pair of upright columns 32 of the main frame of the mixing machine. The means for moving the carriages 32 in synchronism toward and away from the housing 2 comprises two fluid-operated (preferably hydraulic) motors 130 which are indicated in FIG. 2 by vertical phantom lines and each of which is or can be disposed between the respective pair of columns 32. The elevator 29 further comprises a frame or superstructure 31 which can be lifted and lowered by the carriages 30 and is provided with or can raise above or descend onto a conveyance 47 (e.g., a wheel-mounted dolly) which can roll along the floor at the level of the underside of the base 132 to move the lowered second section 16 toward or away from a position of alignment with the housing 2 and first section 15. The conveyance 47 can be permanently connected with the superstructure 31 or can rest on the floor when the carriages 30 are caused to move the superstructure 31 up or down.

The superstructure 31 carries a support 33 for the section 16. This support can comprise two metallic plates which are reinforced by square, rectangular or otherwise profiled preferably tubular stiffening members 34 and carry a platform 35 for an external flange 36 on the lower portion of the section 16. The platform 35 is provided with an annulus of centering pins 37 (only two are shown in FIG. 2) which surround the outer marginal portion of the flange 36 and thus maintain the second section 16 in proper position for lifting into the housing 2 and reattachment to the first section 15. Each of the plates which form part of the support 33 can be flat or can resemble a shell or the like. Each centering pin 37 can constitute a piece of tubing.

The means for centering the superstructure 31 on the carriages 30 of the elevator 29 comprises one or more upwardly extending studs 38 on each carriage and complementary sockets 29 (two are indicated in FIG. 2 by vertical phantom lines) in the adjacent portions of the superstructure 31. Such centering of the superstructure 31 on the carriages 30, plus the centering of flange 36 by the pins 37 of the platform 35, ensures that the second section 16 is automatically ready for reattachment to the section 15 when the carriages 30 are caused to move to their upper end positions. This simplifies reassembly of the gear case 3 and contributes to a shortening of the period of idleness of the mixing machine.

As mentioned above, the elevator 29 further serves to raise and lower the vessel or vessels 7. In order to enable the carriages 30 to receive a vessel 7, the carriages are lowered to the end positions which are shown in FIG. 2 and in which the centering studs 38 are located at a level below the respective sockets 39. Thus, the super-structure 31 is then supported solely by the conveyance 47 and can be moved along the floor, e.g., at right angles to the plane of FIG. 2, for example, to transport the section 16 into a shop if an inspection via windows 116 and/or window (open top 48 of the section 16) indicates that repair work must be carried out in order to eliminate excessive backlash or other defects prior to reassembly of the gear case 3. A vessel 7 is then placed onto the carriages 30 in such a way that its sockets 107 (e.g., in the form of holes two of which are shown in FIG. 1) receive the centering studs 38, and the carriages 30 are ready to lift the vessel 7 toward and into engagement with the lower end of the housing 2.

The thus lifted vessel 7 can remain on the carriages 30 or is separably suspended on the housing 2. Thus, a single elevator 29 suffices to manipulate the relatively heavy second section 16 of the gear case 3 as well as the relatively heavy vessel or vessels 7. The weight of a vessel 7 is considerable when the vessel contains a large batch of miscible material or materials.

A relatively lightweight crane can be employed to lift the rotatably mounted ring gear 19 out of the housing 2. All that is necessary is to operate the lifting mechanism 22 in order to lift the cover 20 off the main portion of the housing 2, to remove or loosen the connectors 21 between the flange 17 of the first section 15 and the gear 19, to remove the lightweight section 15 and to thereupon lift the gear 19 out of the main section of the housing 2 through the open top 24. The gear 19 will be removed after a long period of use, i.e., due to wear upon its teeth. Normal inspection of this gear can be carried out as soon as the cover 20 is lifted off the main portion of the housing 2.

FIG. 1 shows a labyrinth seal 42 which is provided between the first section 15 of the gear case 3 and the housing 2 and serves to seal the driving station 40 from the mixing or product station 41. The seal 42 comprises an annular groove 43 which is open from below and is provided in the underside of the first section 15, and an annular protuberance or projection 44 which is connected to or is integral with the main portion of the housing 2. The projection 44 extends into the groove 43 with minimal clearance when the section 15 is properly installed in the housing 2 and is properly connected to the gear 19.

A dynamic seal 45 (e.g., a sealing ring 45) is installed between the lower end portion of the first section 15 and the housing 2 at a level above the labyrinth seal 42. An advantage of the seals 42, 45 between the first section 15 and the housing 2 is that they need not be exposed or removed or taken apart preparatory to and/or during raising or lowering of the second section 16. This greatly reduces the likelihood of damage to these seals during inspection of the second section 16 and/or of the parts which are mounted in or on this section.

Penetration of miscible material or materials and/or of finished products (such as a propellant or an explosive) into the transmission 4 is further impeded by the aforementioned external annular flange 36 of the section 16 which abuts the underside of the first section 15 in assembled condition of the gear case 3. The flange 36 extends radially outwardly all the way to the annular groove 43 of the labyrinth seal 42. This ensures that the upwardly extending annular projection 44 of the labyrinth seal 42 surrounds the peripheral surface of the flange 36 and acts as a barrier which prevents penetration of miscible material or materials and/or of finished products into the gap between the upper side of the flange 36 and the adjacent underside of the lowermost portion of first section 15. A sealing ring 46 is interposed between the upper side of the flange 36 and the adjacent annular portion of the first section 15 to even further reduce the likelihood of penetration of miscible material or materials and/or of the finished product and/or other foreign matter into the interior of the assembled gear case 3. One of the purposes of the sealing ring 46 is to prevent penetration of foreign matter into the observation windows 116 whence the foreign matter could enter the interior of the section 16. Since the upper side of the section 16 is or can be open (at 48), any foreign matter which would be free to penetrate into the gear case 3 along the outer side of the tubular portion of the section 16 could enter the interior of this section by way of the open top 48.

The improved mixing machine can be modified in a number of ways without departing from the spirit of the invention. For example, the machine can be furnished with two second sections 16. This renders it possible to secure one of the sections 16 to the section 15 and to operate the mixing machine while the other section 16 is being inspected on the superstructure 31 or in a shop. The utilization of plural sections 16 is particularly desirable if the nature of the material or materials to be mixed is such that the parts which are mounted in or on the section 16 must be inspected at frequent intervals. Thus, it is not necessary to inspect a previously used section 16 while the mixing machine 1 is idle. The operators simply replace the previously used section 16 with the spare section 16 (or with a spare section 16) and the machine is ready for renewed use. The previously used section 16 is inspected and, if necessary, repaired in the shop while the mixing machine is in operation. Frequent inspections are necessary and prescribed when the machine is used for the making of explosives, propellants and the like.

The aforediscussed horizontal divisibility of the gear case 3 renders it possible to maintain the mixing machine in operation for much longer periods of time than a conventional upright mixing machine. In addition, it is not necessary to provide a large space above the housing 2 of the improved mixing machine, and the plant in which the machine is being used need not be equipped with one or more large cranes for the express purpose of lifting the section 16 (i.e., the section which contains the gears, bearings and like parts) above and away from the housing.

It is further possible to modify the illustrated mixing machine in such a way that the housing 2 and the upper section 15 of the gear case 3 can be lifted above and lowered toward the lower section 16, or that the housing 2 and the section 15 can be raised to a certain extent and the section 16 can be lowered to a certain extent in order to expose the observation window or windows in the section 15 and/or 16. In either event, the window or windows render it possible to carry out a first or preliminary inspection which might reveal that no further inspection and/or actual maintenance work is necessary. The illustrated construction of the improved mixing machine (wherein the observation windows 116 and 48 are accessible simply in response to downward movement of the section 16 with reference to the housing 2 and section 15) is preferred at this time for the aforediscussed reasons, mainly because it is not necessary to provide a substantial amount of space above the housing 2 and also because it is not necessary to provide a large crane which would have to be employed to lift the entire gear case 3 and the mixing tool or tools to a level above the housing 2.

The provision of observation windows 116 in that (tubular) portion of the section 16 which is surrounded by the section 15 in assembled condition of the gear case 3 is desirable and advantageous because this further reduces the likelihood of penetration of foreign matter into the section 16.

The labyrinth seal 42 between the housing 2 and the section 15 of the gear case 3 is desirable and advantageous because it furnishes a highly satisfactory sealing action even though the parts 2 and 15 do not actually contact each other. This ensures that no heat is generated at such location when the prime mover 9 is on to rotate the gear case 3 with reference to the housing 2. The provision of a substantially cup-shaped first section 15 and of a substantially tubular second section 16 contributes to compactness of the assembled gear case 3.

The open top 48 (additional window) of the section 16 renders it possible to gain access to the planet wheels 10 as soon as the section 16 is lowered to the position of FIG. 2. In such position of the section 16, the open top 48 also affords access to several other parts in the interior of the section 16. Additional parts in the section 16 are accessible by way of the windows 116.

The form-locking connection between the annular lower portion of the section 15 and the flange 36 of the section 16 in assembled condition of the gear case 3 contributes to sealing action between the two sections and assists the sealing means 41, 45, 46 in preventing penetration of foreign matter into the section 16.

A further important advantage of the improved mixing machine is that the overall height of the machine need not be increased in order to permit a downward movement of the section 16 to the position which is shown in FIG. 2. Thus, the elevator 29 operates in the space between the base 132 of the main frame and the housing 2, i.e., in a space which must be provided anyway in order to provide room for raising and lowering of a vessel. The vessel must be lowered to such an extent that it can be moved sideways at a level below the lower ends of the shafts 6*a* and 6*b*.

The centering means 37 and 38–39 constitute optional but desirable features of the improved mixing machine. Such centering means ensure that the section 16 can be raised to proper position for reattachment to the top wall 27 of the section 15 without risking damage to the labyrinth seal 42. This holds true even if the lifting of section 16 to the level of FIG. 1 is initiated and controlled by semiskilled persons.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A mixing machine comprising a housing; a gear case provided in and rotatable relative to said housing about a substantially vertical axis and including a first section journalled in said housing and a second section, said gear case comprising a twin-walled portion having an outer wall forming part of said first section and an inner wall forming part of said second section; fastener means engageable to separably and non-rotatably secure said second section to said first section; at least one upright mixing tool rotatably mounted in said second section; and means for rotating said at least one tool, said rotating means being installed in said second section and said second section being movable downwardly with said at least one tool and with at least a portion of said rotating means relative to said housing and said first section upon disengagement of said fastener means, said inner wall having at least one observation window which is exposed upon downward movement of said second section.

2. A mixing machine comprising a housing; a gear case provided in and rotatable relative to said housing about a substantially vertical axis and including a first section journalled in said housing and a second section; fastener means engageable to separably and non-rotatably secure said second section to said first section; at least one upright mixing tool rotatably mounted in said second section; means for rotating said at least one tool, said rotating means being installed in said second section and said second section being movable downwardly with said at least one tool and with at least a portion of said rotating means relative to said housing and said first section upon disengagement of said fastener means, at least one of said sections having at least one observation window; a frame including a base, said housing being mounted in said frame at a level above and spaced apart from said base; and elevator means provided in said frame and operable to lower said second section away from and to lift said second section toward said housing, said elevator means comprising a plurality of carriages beneath said housing, means for moving said carriages up and down, and a superstructure disposed above said carriages and movable therewith upwardly toward and downwardly away from said housing, said superstructure comprising a support and said second section comprising a flange which comes to rest on said support in raised positions of said carriages and of said superstructure upon disengagement of said second section from said first section.

3. The machine of claim 2, wherein said at least one observation window is available for observation upon downward movement of said second section.

4. The machine of claim 2, wherein one of said sections is at least partially confined in the other of said sections when said second section is secured to said first section.

5. The machine of claim 1, wherein said first section has an underside and said second section has an upper side which abuts or is adjacent said underside when said second section is secured to said first section.

6. The machine of claim 1, wherein said first section at least partially surrounds said second section, said second section including an upper portion and a lower portion, said fastener means being engageable to non-rotatably connect said upper portion to said first section, said at least one tool having a shaft and said shaft being rotatably mounted in at least one portion of said second section.

7. The machine of claim 2, wherein said gear case includes a twin-walled portion having an outer wall forming part of said first section and an inner wall forming part of said second section.

8. The machine of claim 7, wherein said at least one observation window is provided in said inner wall and is exposed upon downward movement of said second section.

9. The machine of claim 1, further comprising a prime mover and means for transmitting torque from said prime mover to said first section.

10. The machine of claim 7, wherein said rotating means includes at least one planetary transmission and said transmission includes a planet carrier rigid with said gear case.

11. The machine of claim 9, wherein said torque transmitting means comprises a first gear driven by said prime mover and a second gear rigid with said gear case and mating with said first gear.

12. The machine of claim 11, wherein said second gear is a ring gear which is coaxial with and is connected to said first section.

13. The machine of claim 11, wherein said second gear is rotatably mounted in said housing and said torque transmitting means further comprises a flange which is rigid with said first section and means for separably connecting said flange to said second gear.

14. The machine of claim 1, further comprising a seal between said housing and one of said sections.

15. The machine of claim 14, wherein said seal is a labyrinth seal comprising an annular groove in said first section and an annular projection provided on said housing and extending into said groove.

16. The machine of claim 1, wherein said first section constitutes an inverted cup and said inner wall includes a tube which is at least partially received in said cup when said second section is secured to said first section.

17. The machine of claim 1, wherein said first section has a top wall and said fastener means includes at least one threaded fastener which secures said top wall to said second section, said at least one threaded fastener having a head which is accessible from above said top wall.

18. The machine of claim 1, wherein said housing includes a main portion which at least partially surrounds said gear case, a cover above said gear case and connector means for separably connecting said cover to said main portion.

19. The machine of claim 18, wherein said rotating means includes a planetary transmission having a sun wheel carried by said cover.

20. The machine of claim 19, further comprising means for lifting said cover and said sun wheel off said main portion upon disengagement of said connector means.

21. The machine of claim 2, wherein said second section has an open top and a tubular portion adjacent said open top, said at least one observation window being provided in said tubular portion and being accessible upon downward movement of said second section.

22. The machine of claim 1, wherein said second section has an annular external flange and said first section has an annular portion above said flange, and further comprising a sealing ring between said portion of said first section and said flange.

23. The machine of claim 1, further comprising a frame, said housing being mounted in said frame at a first level and further comprising a vessel movably mounted in said frame at a second level below said first level and beneath said gear case.

24. The machine of claim 1, further comprising a frame, said housing being mounted in said frame and further comprising elevator means provided in said frame and operable to lower said second section away from and to lift said second section toward said housing.

25. The machine of claim 24, wherein said frame includes a base and said housing is located in said frame at a level above and spaced apart from said base.

26. The machine of claim 25, wherein said elevator means comprises a plurality of carriages beneath said housing, means for moving said carriages up and down, and a superstructure disposed above said carriages and movable therewith upwardly toward and downwardly away from said housing.

27. The machine of claim 26, wherein said moving means includes at least one fluid-operated motor.

28. The machine of claim 26, wherein said superstructure comprises a floor-contacting portion which comes to rest on the floor at least in response to lowering of said carriages, said carriages being movable to lower end positions in which said superstructure is disengaged from and is movable along the floor relative to said carriages.

29. The machine of claim 28, wherein said floor-contacting portion includes a vehicle.

30. The machine of claim 26, wherein said carriages are movable with and relative to said superstructure, and further comprising means for centering said superstructure on said carriages.

31. The machine of claim 30, wherein said centering means comprises at least one upwardly extending stud on each of said carriages and complementary sockets provided in said superstructure for said studs.

32. The machine of claim 2, wherein said support includes a plurality of discrete reinforced portions on said superstructure.

33. The machine of claim 2, wherein said support includes a plurality of upwardly extending centering elements for the flange of said second section.

34. The machine of claim 33, wherein said centering elements form an annulus which surrounds said flange.

35. The machine of claim 1, wherein said housing includes a main portion, a cover and means for separably connecting said cover to said main portion, said cover being located above said gear case and further comprising means for lifting said cover off said main portion to afford access to at least one section of said gear case.

36. A mixing machine comprising a housing including a main portion, a cover and means for separably connecting said cover to said main portion; a gear case provided in and rotatable relative to said housing about a substantially vertical axis and including a first section journalled in said housing and a second section, said cover being located above said gear case; fastener means engageable to separably and non-rotatably secure said second section to said first section; at least one upright mixing tool rotatably mounted in said second section; means for rotating said at least one tool, said rotating means being installed in said second section and said second section being movable downwardly with said at least one tool and with at least a portion of said rotating means relative to said housing and said first section upon disengagement of said fastener means, at least one of said sections having at least one observation window; and means for lifting said cover off said main portion of said housing to afford access to at least one section of said gear case, said lifting means comprising a first upright shaft on said main portion, a second upright shaft coaxial with said first shaft and connected to said cover, one of said shafts being telescoped into the other of said shafts and said second shaft being movable axially of and rotatable relative to said first shaft, and means for moving said second shaft axially with reference to said first shaft.

37. The machine of claim 36, wherein said lifting means further comprises an arm which connects said cover to said second shaft, said moving means comprising a fluid-operated motor.

38. The machine of claim 36, wherein said moving means comprises a fluid-operated cylinder and piston unit which is coaxial with said shafts.

* * * * *